US008984697B2

(12) United States Patent
Knopow et al.

(10) Patent No.: US 8,984,697 B2
(45) Date of Patent: Mar. 24, 2015

(54) QUICK PICKUP DEVICE FOR DEBRIS ON ANY SURFACE WITH POSITIVE CAPTURE

(75) Inventors: Jeremy F. Knopow, Burlington, WI (US); Keegan J. Trester, Milwaukee, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 266 days.

(21) Appl. No.: 13/478,731

(22) Filed: May 23, 2012

(65) Prior Publication Data

US 2012/0304405 A1 Dec. 6, 2012

Related U.S. Application Data

(60) Provisional application No. 61/491,934, filed on Jun. 1, 2011.

(51) Int. Cl.

| | |
|---|---|
| ***A47L 25/00*** | (2006.01) |
| ***A47L 25/08*** | (2006.01) |
| ***A47L 11/40*** | (2006.01) |
| ***B08B 7/00*** | (2006.01) |
| ***A47L 11/33*** | (2006.01) |

(52) U.S. Cl.

CPC ..... *A47L 25/005* (2013.01); *A47L 11/4013* (2013.01); *A47L 11/4041* (2013.01); *B08B 7/0028* (2013.01); *A47L 11/33* (2013.01)

USPC ..... 15/104.002

(58) Field of Classification Search

CPC ..... A47L 13/10; A47L 25/00

USPC ..... 15/104.002

See application file for complete search history.

(56) References Cited

U.S. PATENT DOCUMENTS

| | | | | |
|---|---|---|---|---|
| 2,269,712 | A * | 1/1942 | Drew | 442/260 |
| 4,080,683 | A | 3/1978 | Yi | |
| 4,575,890 | A | 3/1986 | Hidle | |
| 6,298,517 | B1 | 10/2001 | McKay | |
| 6,405,403 | B1 | 6/2002 | McKay | |
| 6,550,092 | B1 | 4/2003 | Brown et al. | |
| 6,735,806 | B2 | 5/2004 | Blum et al. | |
| 6,810,554 | B2 | 11/2004 | McKay | |
| 6,865,765 | B2 | 3/2005 | Aalbers | |
| 6,895,627 | B1 | 5/2005 | Lin | |
| 6,954,963 | B2 | 10/2005 | McKay | |
| 7,020,926 | B2 | 4/2006 | McKay | |
| 7,039,982 | B1 | 5/2006 | McKay | |
| 7,090,908 | B1 | 8/2006 | McKay | |
| 7,137,165 | B2 | 11/2006 | Shizuno et al. | |

(Continued)

FOREIGN PATENT DOCUMENTS

| | | |
|---|---|---|
| EP | 2324750 A1 | 5/2011 |
| WO | WO2007070520 | 6/2007 |

(Continued)

OTHER PUBLICATIONS

PCT/US2012/039501 International Search Report dated Sep. 14, 2012.

*Primary Examiner* — Randall Chin

(57) ABSTRACT

A device for quickly cleaning a variety of surfaces is provided that preferably utilizes a positive capture roller and three-dimensional capture matrix. In particular, the roller is tacky and is in close relationship with a three-dimensional capture media. The roller may be refreshed by a washing mechanism and the media may be replaceable.

17 Claims, 14 Drawing Sheets

(56) References Cited

U.S. PATENT DOCUMENTS

| | | | | |
|---|---|---|---|---|
| 7,188,384 | B2 | 3/2007 | McKay | |
| 7,213,291 | B2 | 5/2007 | Cheng | |
| 7,234,188 | B1 | 6/2007 | McKay | |
| 7,337,561 | B2 | 3/2008 | Potashnick | |
| 7,350,257 | B2 | 4/2008 | McKay | |
| 7,395,574 | B2 | 7/2008 | McKay | |
| 7,559,108 | B2 | 7/2009 | Forte | |
| 7,657,958 | B2 | 2/2010 | Korbonski et al. | |
| 7,676,877 | B2 | 3/2010 | Policicchio et al. | |
| 7,721,372 | B2 * | 5/2010 | Knopow et al. | 15/27 |
| 7,793,377 | B2 | 9/2010 | Knopow et al. | |
| 7,810,204 | B2 | 10/2010 | Godfroid et al. | |
| 7,814,613 | B1 | 10/2010 | Whittaker | |
| 7,856,690 | B2 | 12/2010 | Tuman et al. | |
| 2002/0023307 | A1 | 2/2002 | Haba et al. | |
| 2002/0088070 | A1 | 7/2002 | Cho | |
| 2003/0088928 | A1 | 5/2003 | Shizuno et al. | |
| 2004/0019986 | A1 | 2/2004 | Corrado et al. | |
| 2004/0058116 | A1 | 3/2004 | Sano et al. | |
| 2004/0134003 | A1 * | 7/2004 | McKay, Jr. | 15/104.002 |
| 2004/0134004 | A1 | 7/2004 | Kaleta | |
| 2005/0050660 | A1 * | 3/2005 | McKay et al. | 15/104.002 |
| 2005/0184099 | A1 | 8/2005 | McKay | |
| 2005/0204493 | A1 | 9/2005 | Legus et al. | |
| 2006/0174435 | A1 | 8/2006 | McKay | |
| 2006/0195993 | A1 | 9/2006 | O'Neill et al. | |
| 2006/0225233 | A1 | 10/2006 | McKay | |
| 2007/0039108 | A1 | 2/2007 | Sung | |
| 2008/0078050 | A1 | 4/2008 | Anderson | |
| 2009/0025752 | A1 | 1/2009 | Rui | |
| 2009/0097902 | A1 | 4/2009 | Lemmon | |
| 2009/0126133 | A1 | 5/2009 | Ryu | |
| 2010/0251497 | A1 | 10/2010 | Arnold | |
| 2010/0306939 | A1 | 12/2010 | Dingert | |
| 2010/0319148 | A1 | 12/2010 | Yu | |

FOREIGN PATENT DOCUMENTS

| | | |
|---|---|---|
| WO | WO2009065450 | 5/2009 |
| WO | WO2009077169 | 6/2009 |
| WO | WO2009149722 | 12/2009 |

* cited by examiner

QUICK PICKUP DEVICE FOR DEBRIS ON ANY SURFACE WITH POSITIVE CAPTURE

CROSS-REFERENCE TO RELATED APPLICATIONS

The present application claims the benefit of priority to U.S. Provisional Patent Application Ser. No. 61/491,934 filed Jun. 1, 2011 and entitled Quick Pickup Device For Debris On Any Surface With Positive Capture, the entirety of which is hereby incorporated by explicit reference thereto.

FIELD OF THE INVENTION

The present invention relates to surface cleaning devices, and more specifically to a surface cleaning device including a roller and one or more tacky surfaces for picking up dust, lint, and other debris from a variety of surfaces. The inventive tacky surfaces can be periodically refreshed by the user as well as having a self-refreshing mechanism.

BACKGROUND OF THE INVENTION

A number of different surface cleaning devices utilizing adhesive, tacky, attractive, or sticky surfaces, i.e. having "positive capture", have been developed for cleaning various surfaces. The majority of these devices include a single roller having a sheet of material with a tackified outer surface disposed on the exterior of the roller. The adhesive on the roller is generally capable of picking up lint, dust, and other debris on the surface as the roller is contacted with the surface. As the roller moves along the surface, the tackified surface contacts and adheres to the lint, dust, and debris on the surface, thereby lifting the debris off of the surface and onto the roller.

However, with regard to cleaning devices of this type, the roller has a limited number of uses. This is because the adhesive material on the exterior of the roller must be continually cleaned or replaced based on the amount of debris that adheres to the roller as it moves across the surface.

In order to overcome this shortcoming, other cleaning devices have been developed that include a pair of rollers. A continuous web of an adhesive sheet material is connected between the rollers. In these devices, the adhesive sheet material can be advanced from a web supply roller toward a web take-up roller as the device is used in order to provide a number of sequential clean sections of the adhesive sheet web when the previous section has collected a sufficient amount of lint, dust, or debris to render the previous section no longer usable. Because the adhesive sheet is continually moved onto the take-up roll and off of the supply roll, the device can readily present a clean section of the adhesive sheet for use in cleaning a surface.

Examples of devices of this type include Hester, U.S. Pat. No. 4,083,075. This patent discloses a lint pickup device that includes a pair of rollers formed as a supply roller and a take-up roller that are disposed within a cartridge and which support a continuous web of an adhesive sheet utilized to clean carpets, rugs, and other surfaces of lint.

Blum et al., U.S. Pat. No. 6,735,806, discloses another device of this type including a tacky roller for improved surface cleaning in which a continuous sheet of a tackified web is applied to a surface to clean the surface. The web is supported by a pair of rollers disposed within the device and by a number of contact rollers which maintain the web in contact with the surface to be cleaned as the web moves continuously between the rollers. The device also includes a brush that contacts and provides additional cleaning to the surface.

Still another cleaning device of this type is shown in Plankenhorn, U.S. Pat. No. 6,859,976, which discloses a cleaning device with continuous action wiping and sweeping having a continuous web of an adhesive sheet material connected between a supply roller and a take-up roller. The web of the adhesive material is advanced from the supply roller onto the take-up roller by a variety of mechanisms, in order to provide the device with a continually clean tackified portion of the web for cleaning purposes.

Shizuno et al., U.S. Pat. No. 7,137,165, discloses a cleaning device with an adhesive roll cleaner having a single-sided adhesive sheet wound around a core tube into a roll with the adhesive side facing out. Here the adhesive of the adhesive sheet comprises a hot-melt adhesive, solvent adhesive, or aqueous adhesive. The adhesive is applied to the base sheet at a coating weight of 15 to 50 g/m$^2$ and a silicone release agent is applied to a back side of the adhesive sheet. The adhesive roll maintains an outer diameter within a range of 22 to 40 mm from start to end of use and the roll has a width of 180 to 300 mm.

Similarly, U.S. Pat. No. 7,676,877 to Policicchio et al. is a cleaning implement comprising a sweeper head with a removable collection bin with an adjustable height and an opening for receiving debris. The sweeper head has a rotating member for projecting loose soils from the surface being cleaned into the collection bin and a disposable cleaning substrate removably attachable to the collection bin.

Finally, U.S. Pat. No. 7,793,377 to Knopow et al. discloses an adhesive web having two take-up rollers.

Each of the above-discussed references is now expressly incorporated herein by reference.

In the present invention, it is desirable to develop a cleaning device utilizing one or more positive capture elements that may be automatically refreshed or easily removed and replaced with a minimum of waste materials generated. It is also desirable that the soils and other debris be effectively captured so that they are not subsequently dispersed onto the cleaned area.

SUMMARY OF THE INVENTION

According to one aspect of the present invention, a positive capture roller cleaning device is provided mounted to a housing that may be either hand held or as a sweeping attachment. The roller is substantially covered with an external roller material having some positive capture quality such as adhesiveness, stickiness, attractiveness, e.g., electrostatic attraction, or tackiness such that debris that is proximate or in contact with the roller will adhere to the roller in some fashion.

The device also includes a refreshing mechanism for the roller wherein the time between cleaning or replacement of the roller is extended. The refreshment mechanism may deposit the debris collected by the roller into a collection bin. The refreshment mechanism may also refresh the roller surface by embedding the debris into the external roller material or may expose a new tacky material or less debris-laden external roller material.

The collection bin may have a mechanism for retaining the debris such as a mechanical one-way channel. Alternatively, it may include a plurality of positive capture 3-dimensional (3D) matrix elements or capture media that have sticky or tacky surfaces, for example, spheres, polygons, cylinders, cubes, and so forth.

Another aspect of the invention is to provide a refreshing floor sweeper that includes a cleaning element having a handle for grasping by the user and coupled to a base. The base may include a housing with a central opening configured to receive a roller that extends at least partially out of the housing for contacting the surface to be cleaned. The roller includes a tacky material to enable the roller to pick up and retain debris from the surface to be cleaned. The tackiness of the material is such that the debris is easily picked up off of the surface to be cleaned but not so tacky that the roller sticks to the surface to be cleaned when it is rolled over it.

In one embodiment, a capture media cartridge is configured to be secured within the housing to define a means for capturing the picked-up debris as well as for cleaning the roller. The cartridge preferably provides a 3D matrix for cleaning the roller and securing debris picked up by the roller. In particular, the cartridge includes a plurality of tacky or wet spherical elements that may include superabsorbent compounds such that the surface tension thereof is such that the debris may be picked up off the roller but slick enough so that the elements do not bunch or stick together. The elements are preferably contained within a mesh or cage that allows them to interface with the roller but secures them within the cartridge to prevent the elements from falling out of the cartridge.

The housing preferably additionally includes a central brush that assists in cleaning the picked-up debris off of the roller. The housing additionally includes a number of containment brushes secured to an underside of the housing and engageable with the roller. The containment brushes prevent debris contained within the housing from falling out of the housing.

Another aspect of the invention is to provide a cleaning device with a manually grippable handle attached to a base with a positive capture roller and a debris capture matrix contained in the base. The matrix includes a 3-dimensional capture media that may be replaceable. The roller is tacky and is refreshed by a refreshing member.

Yet another aspect of the invention is to provide for quick pick up of debris on any surface with positive capture using a base including a bin having a cleaning side brush and capture top brushes. The base also includes a cage for holding debris and a capture matrix, as well as a tacky polyurethane textured roller that is in contact with the cleaning brush. The textured roller may have any number of patterns disposed thereon including a diamond shape pattern for assisting in the picking up of debris and removal therefrom. The capture matrix may include a plurality of media made of a carageenan-based gel formulation. The matrix may be a plurality of cylinders made of a gel and restrained by a cage contained in a cartridge. As well, the matrix may be a multitude of removable and disposable gel balls. Furthermore, the matrix may be a plurality of free-floating 3-dimensional gel media in a replaceable cartridge refill.

Still another aspect of the invention is to provide for quick pick up of debris on any surface with positive capture while providing mechanisms for refreshing the roller and/or capture matrix. For example, the cleaning and refreshing of the roller may be provided by a brush acting on the roller and/or by a member that provides a flicking action. In one embodiment, the flicking action is provided by a brush in communication with the pickup roller that cleans the roller as well as directs the debris from the roller into the bin. Other brushes may be provided that are stiff and angled to prevent the debris from escaping the bin. Alternatively, rotating cleaning/refreshing brushes may be provided that contact the roller. In another embodiment, the cleaning device may also have a wick to refresh the roller surface where pressure is provided by the wick on the roller. In the alternative, the roller may contain a gel that is refreshed by peeling, sanding, or scraping, or the roller may be a replaceable refill. The roller may also include kneadable putty and a kneading member that refreshes the puttied surface of the roller.

In yet another aspect of the device according to at least one embodiment of the invention, the device may include a disposable roller that may be selectively replaced with a new roller once the roller has lost sufficient effectiveness for picking up debris. In the present embodiment, the device includes a housing having a base member, a rear door member, and a lid member. The rear door member may be movably coupled to the base member by a hinge arrangement disposed therebetween. The rear door member may be secured in place so as to not rotate during operation by way of a pair of opposed clips connected the base member to the rear door member. In this manner, the operator of the device may, as desired, unlock and lock the rear door member relative to the base member and expose the rear of the device for cleaning, maintenance or the like.

The rear door member may be configured to house and rotatably support a rear wheel arrangement, which may include a pair of opposed wheels at each end of the device. The wheels may be coupled to the rear door member by an axle, pin or similar element for rotation there. The wheels along with the disposable roller are configured to enable movement of the device over a surface to be cleaned.

The base member may have a two-piece construction including a rear base member and a forward base member, which together define an interior in which the roller is rotatably coupled and movably secured. The forward base member may be movably coupled to the rear base member to enable the operator to remove or replace the roller. In at least one construction, the rear and forward base members are secured to one another by way of a vertical hinge arrangement about which the forward base member may be rotated to disengage from the roller on either side thereof. The forward base member may include a coupling arrangement for receiving an axle, pin, or the like of the roller on either side thereof for rotatably securing the roller thereto. Accordingly, as desired, to remove the roller from the base member, the operator may rotate the forward base member away from the roller on each side thereof such that the axle, pin, or other structure is disengaged therefrom for selective removal thereof.

The roller may coated with or otherwise have adhered to it a gel material configured to pick up debris that the roller encounters during operation. Moreover, the roller may be impregnated with any number of agents for enhancing tackiness, durability, fragrance, and the like.

The base member may be coupled to the lid member at a forward edge thereof. In one embodiment, the base member is coupled to the lid on either side by a clip arrangement that operates similarly to the clip arrangement between the base member and the rear door member. In this manner, the lid may be movable relative to the base member to selectively expose the roller for removal, cleaning, applying a treatment thereto, or the like. In one embodiment, the lid may be rotatable between a first, operative position in which the roller is engageable with the surface to be cleaned, a second, non-operative position in which the lid is rotated to cover the surface-engaging portion of the roller, and a third, refilling position in which the lid is moved away from the roller so that the roller may be removed or replaced.

Numerous other aspects, features, and advantages of the present invention will be made apparent from the following detailed description taken together with the drawing figures.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings and photos accompanying and forming a part of this specification, wherein like reference numerals designate the same elements in the several views, and in which.

DETAILED DESCRIPTION OF THE PREFERRED EMBODIMENT

Figure 1:
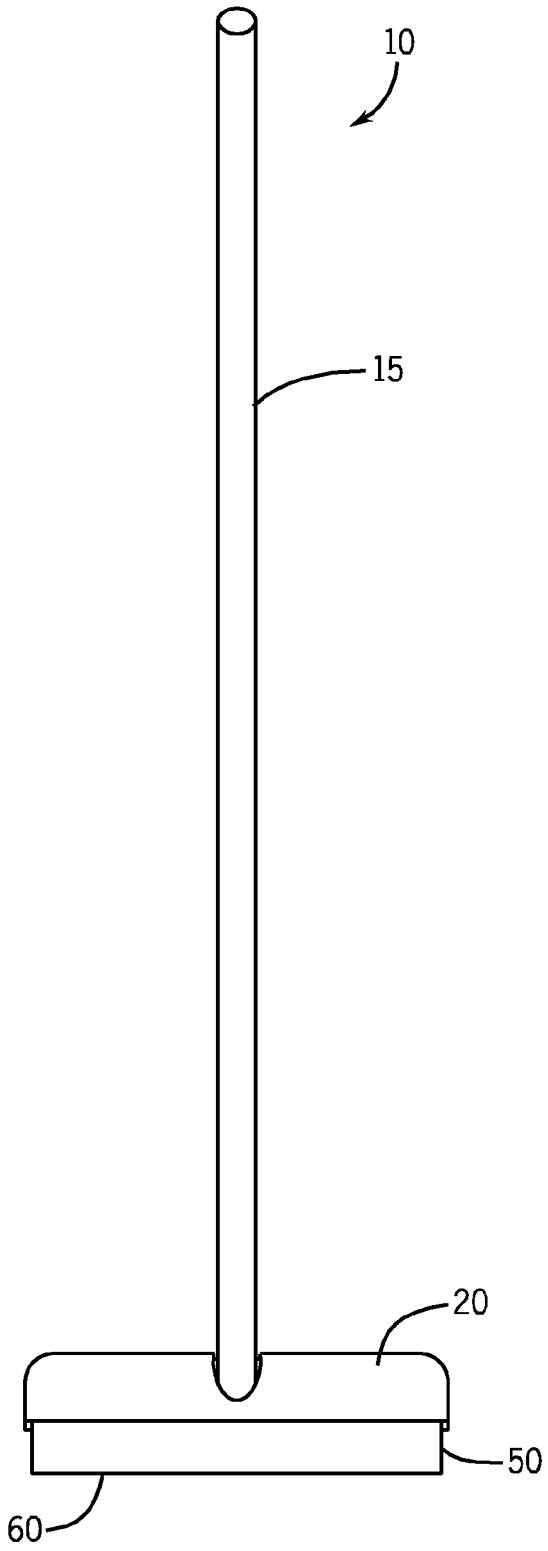
FIG. 1 is an isometric view of the pickup device constructed according to the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "connected," "including," and "comprising" and variations thereof is meant to encompass the items listed thereafter and equivalents thereof as well as additional items and equivalents thereof.

With reference now to the drawing figures in which like reference numerals designate like parts throughout the disclosure, a roller quick pickup cleaning device constructed according to the present invention is indicated generally with the reference numeral 10 in FIG. 1.

In one embodiment, as best shown in FIGS. 1-8, the quick pickup cleaning device 10 has a long handle 15 and a base 20. The base 20 preferably further comprises a collection bin 25. The bin 25 preferably includes a cage or carrier 30 and cartridge 40. A roller 50 having a tacky surface 60 is operably connected to the base 20.

A roller clean-off apparatus, e.g., a wiper or brush 55, may be located in the base 20 near the roller 50. The wiper or brush, or preferably both, cleans debris from the roller surface and reconstitutes the tackiness of the roller. In one embodiment, the wiper may be connected to a pad that adds a liquid to the wiper which is then transferred to the roller surface. The pad and brush may be contained in the cartridge 40.

Figure 2:
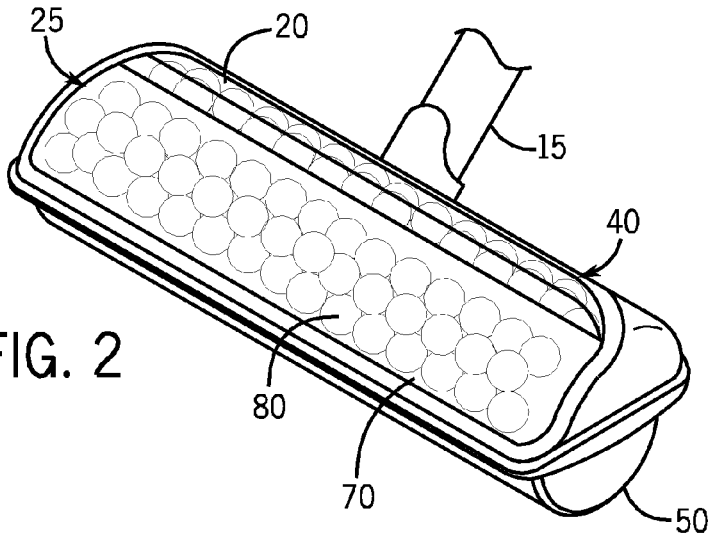
FIG. 2 is a magnified, isometric view of the base of the pickup device of FIG. 1 wherein the head has a partially transparent cover.
Figure 13:
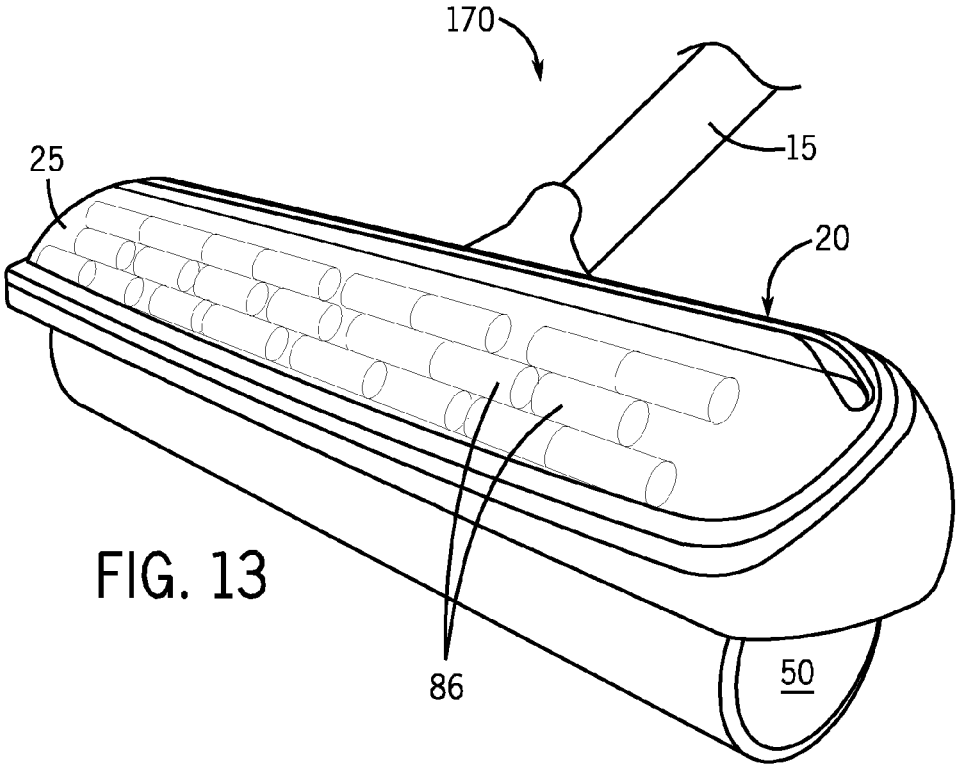
FIG. 13 is an isometric view of the base of the pickup device constructed according to the present invention wherein the head has a partially transparent cover showing cylindrical capture media.

A dirt capture or catching matrix or media 70 is located within the cartridge 40 as best shown in FIG. 2. In one preferred embodiment, the dirt-catching matrix 70 consists of a plurality of capture media including tacky spheres or balls 80. In one embodiment, such as that shown in FIG. 13, the capture media may be cylinders 86.

Figure 3:
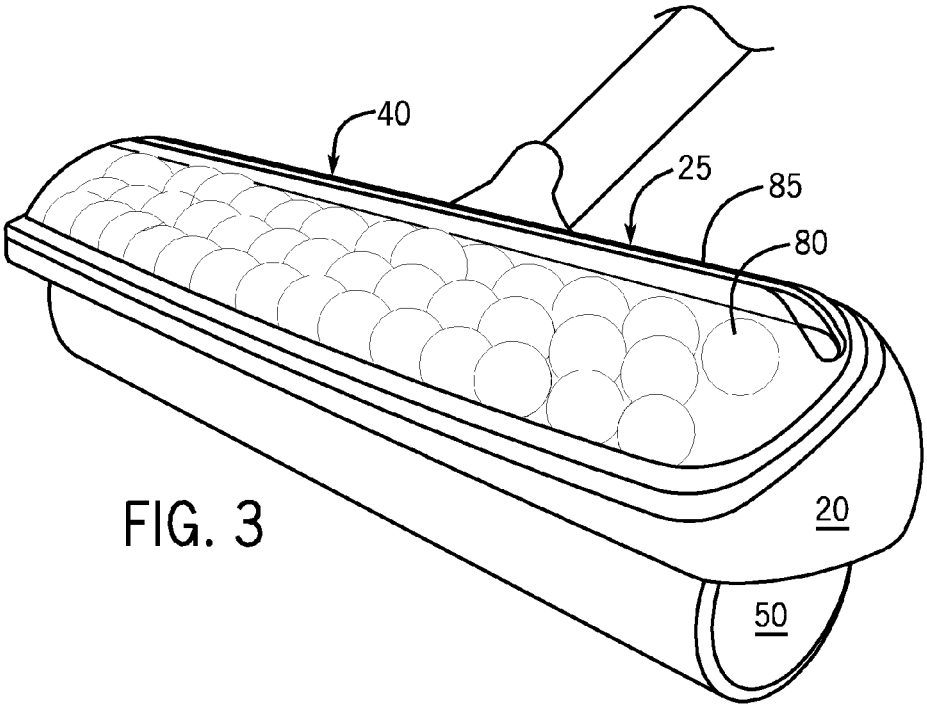
FIG. 3 is a more magnified, isometric view of the base of the device of FIG. 2.
Figure 4A:
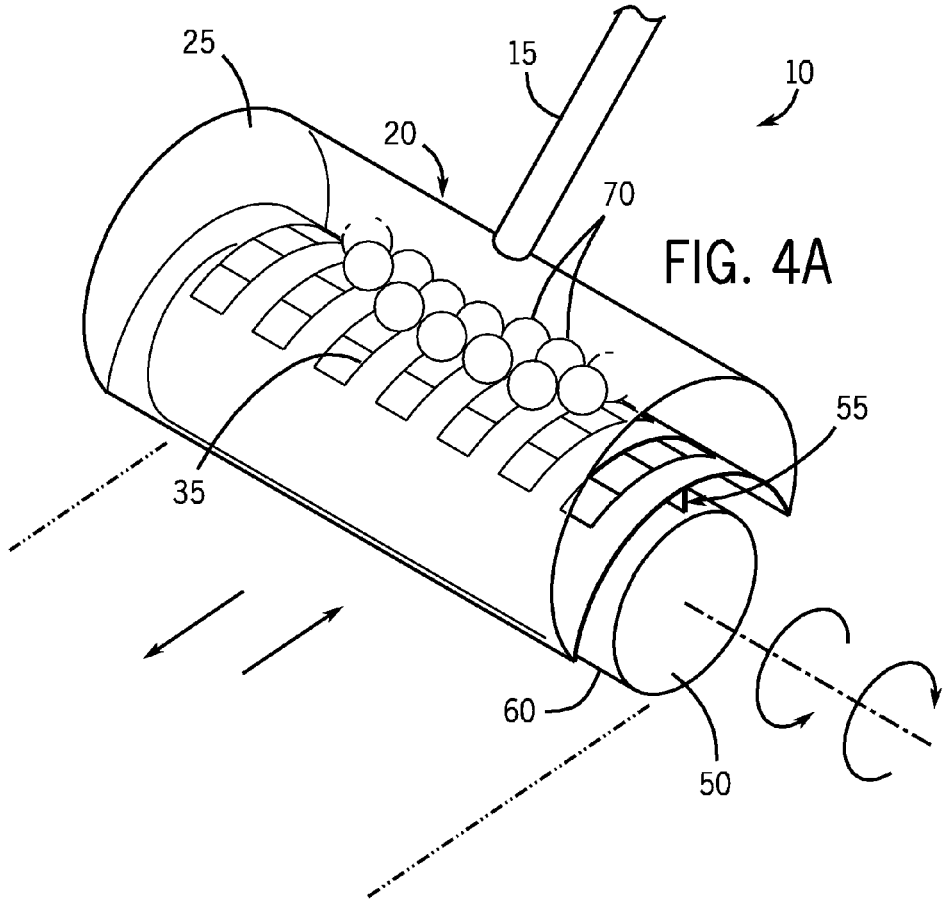
FIG. 4A is an isometric view of the inventive pickup device of FIG. 1 in use.
Figure 4B:
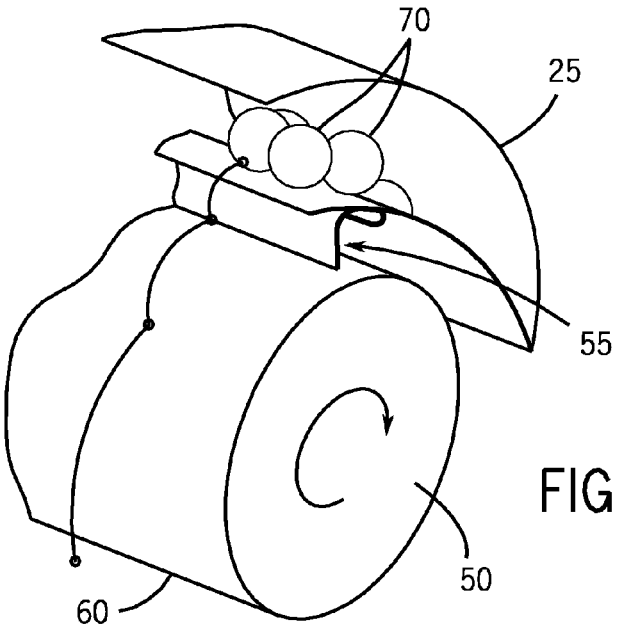
FIG. 4B is an schematic showing a path of travel of a piece of debris while the inventive pickup device of FIG. 4B is in use.

In one embodiment, as shown in FIG. 3, the bin 25 holding the cartridge 40 may contain a cover 85 that is transparent or see-through. As the individual balls 80 and cartridge 40 capture dirt, they provide a visual cue to the user through the transparent cover 85. Once significant dirt is collected, the individual balls 80 lose their ability to collect any more dirt and must be removed and/or replaced.

Figure 7:
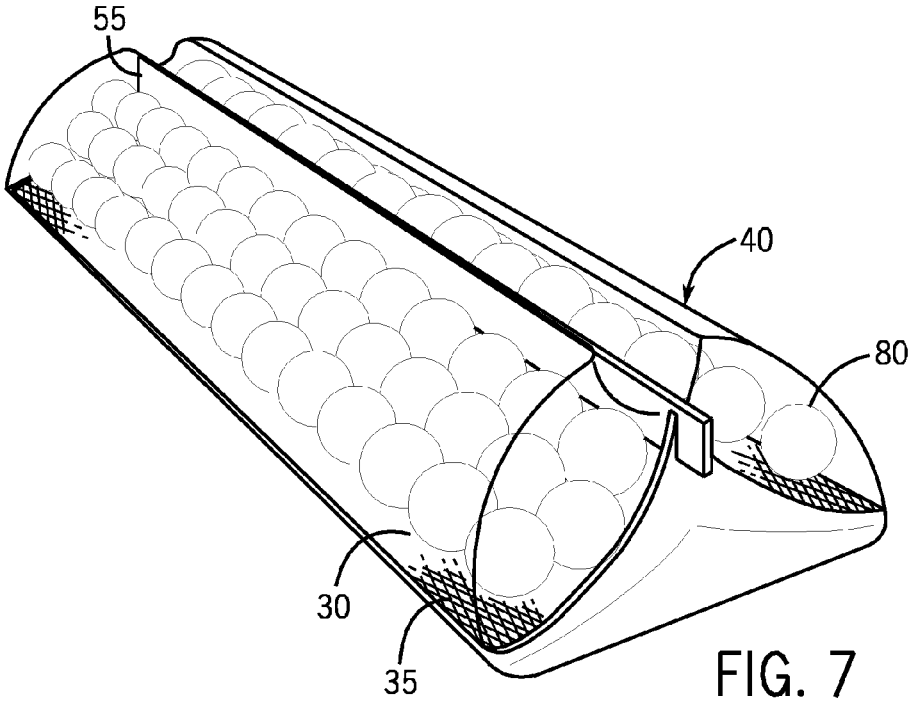
FIG. 7 is an isometric view of a refill cartridge of the pickup device of FIG. 1.

FIG. 7 shows a cartridge 40 containing individual balls 80 after the cartridge has been removed from the base. As can be seen in FIG. 7, a mesh or grate material 35 preferably forms the cage or a carrier 30 (here within the cartridge 40) to hold the balls 80 and also the collected dirt in place.

Figure 5:
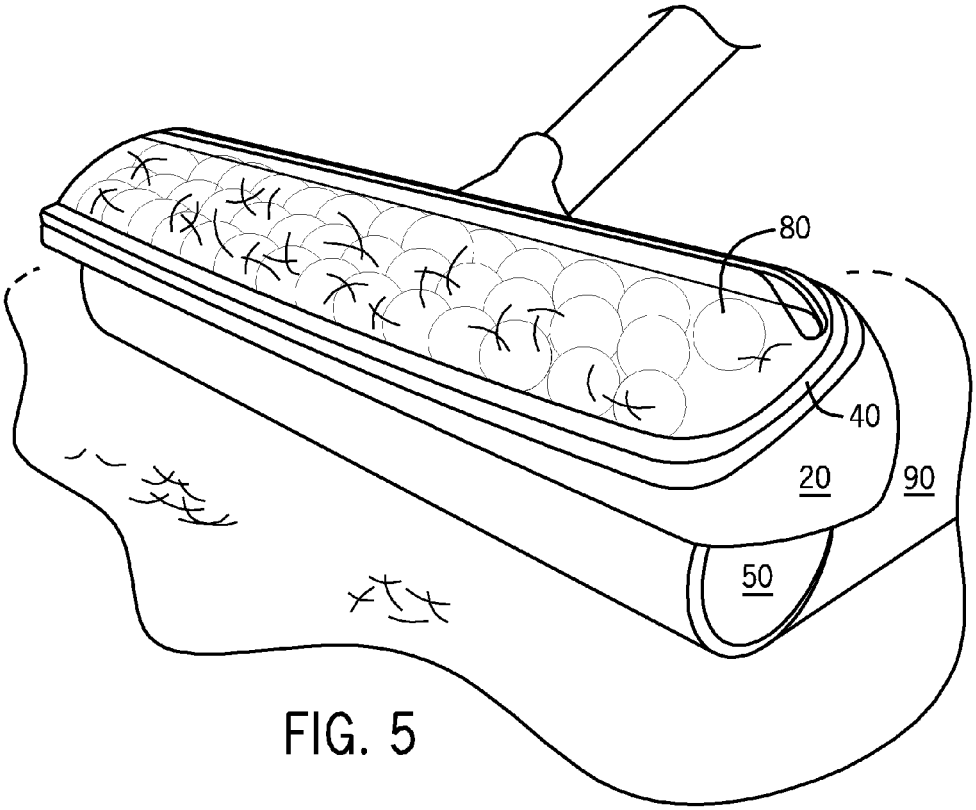
FIG. 5 is an isometric view of the inventive pickup device of FIG. 1 after some use.

FIG. 5 shows the cartridge in place within the base 20. In this Figure, the user has collected a variety of dirt off of a surface 90 which can be seen within the cartridge 40. The dirt has collected on and/or around the individual balls 80, as shown.

Figure 6:
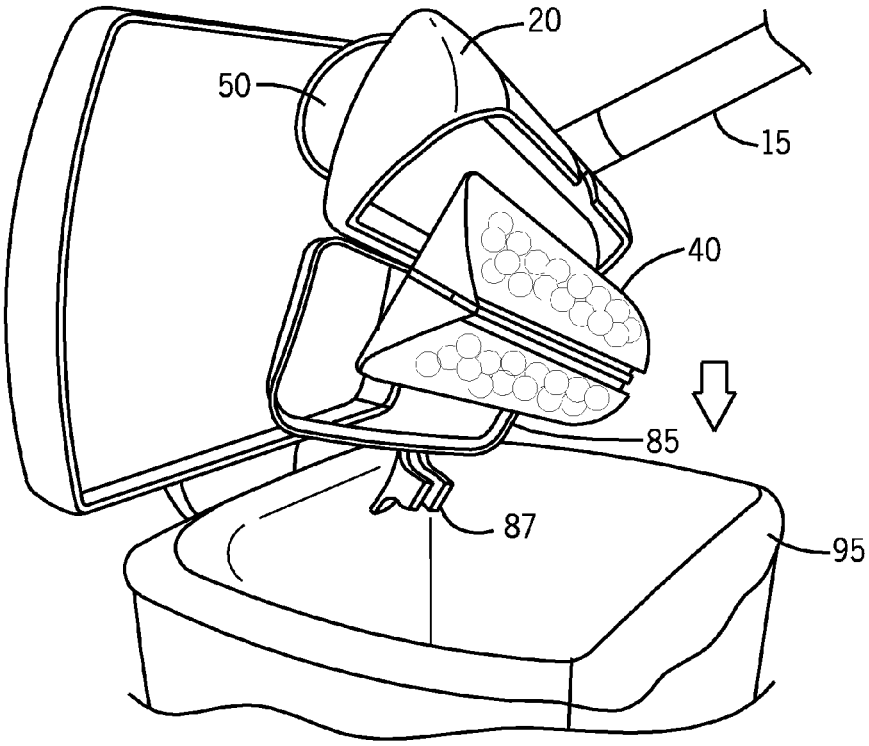
FIG. 6 is an exploded isometric view of the device of FIG. 1 showing disposal of a used cartridge.

FIG. 6 shows the cover 85 of the base 20 being opened to allow the user to drop the used-up cartridge 40 into a trash pail 95. Preferably, the cover 85 has a lift mechanism 87 to allow the opening of the cover without the user getting dirty.

Figure 8:
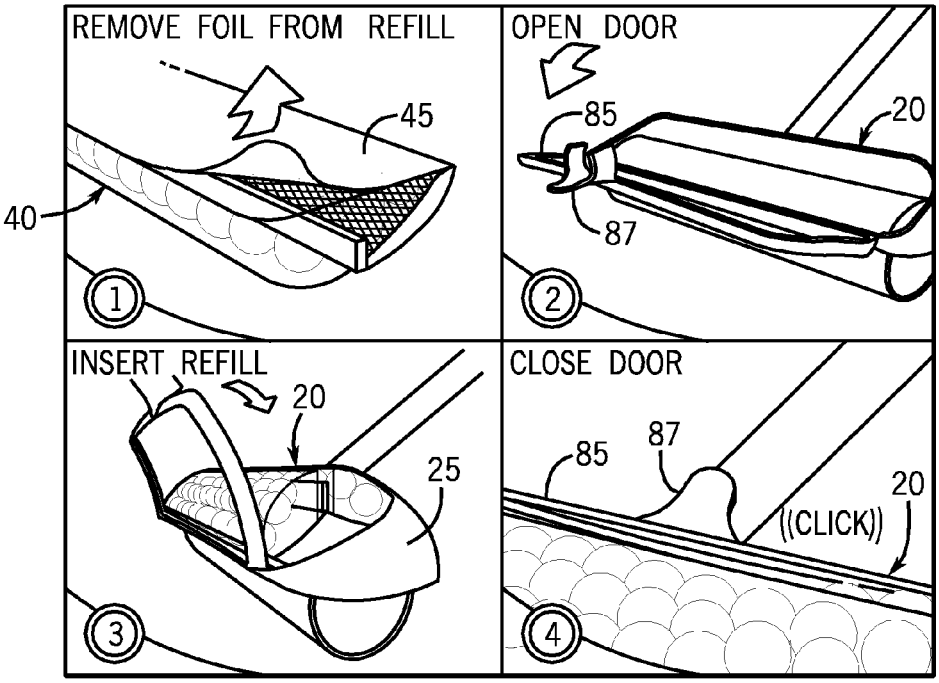
FIG. 8 is a series of exploded, isometric views of the device of FIG. 3 showing the replacement of the device's cartridge.

FIG. 8 shows typical steps for a use and operation of loading and unloading the cartridge 40. The cartridge 40 is preferably packed in a package 45 in order to keep it fresh and dirt-free. Once the cartridge 40 is removed from the package 45, the door or cover 85 is opened up in the base 20. The cartridge 40 is then placed in the bin 25 of the base 20. The cover or door 85 is then closed and the lift mechanism 87 may be clicked into place which preferably locks the cover 85 closed.

Figure 9:
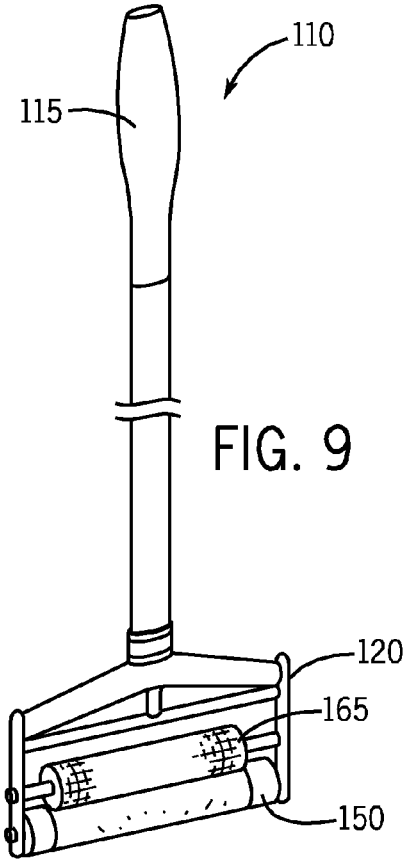
FIG. 9 is a front perspective view of a second embodiment of the inventive device with parts removed.
Figure 10:
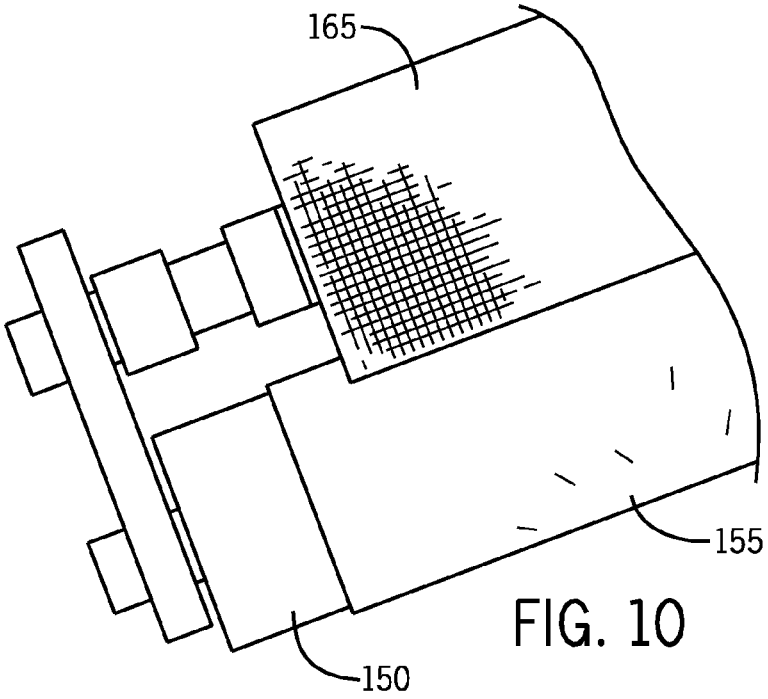
FIG. 10 is a magnified, isometric view of a roller and refreshing wheel of the inventive pickup device of FIG. 9.
Figure 11:
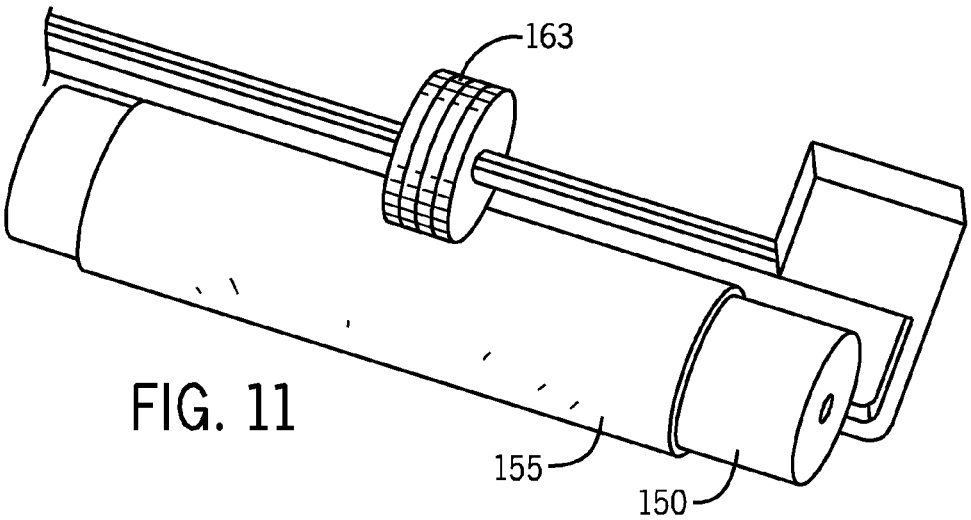
FIG. 11 is a front perspective view of another embodiment of the inventive device with parts removed.
Figure 12:
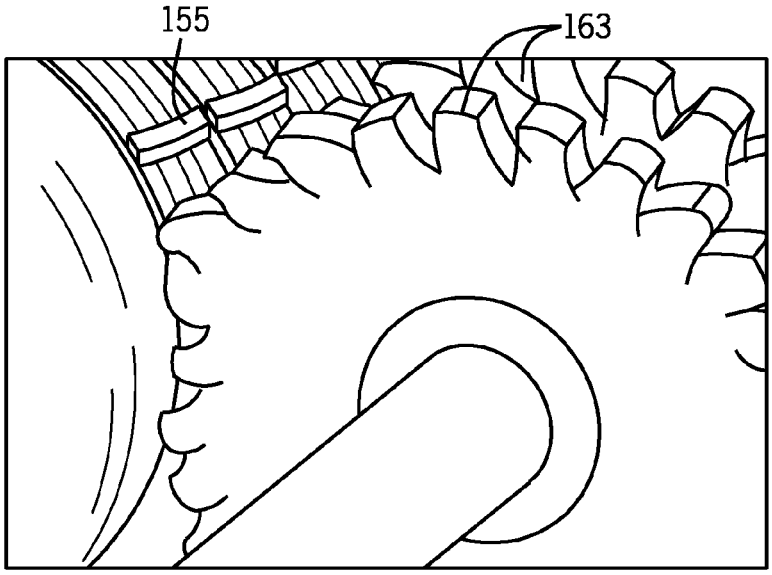
FIG. 12 is a magnified, isometric view of a roller and refreshing wheels of the inventive pickup device of FIG. 11.

In another embodiment, for example, FIGS. 9-12, the inventive sweeper device 110 of the present disclosure contemplates a handle 115 and a base 120. The base 120 preferably includes a single main roller 150 in operative communication with a plurality of refresher wheels 163 (FIGS. 11 and 12) or a refresher roller 165 (FIGS. 9 and 10). Further, a coating 155 is provided on the main roller 150 to make it tacky. In one embodiment, the tacky material 155 on the roller 150 is a putty material coating. In addition, the putty material 155 may be continuously engaged with the refreshing wheels 163. This sweeper 110, however, does not include a brush disposed near the main roller. However, in one embodiment, the brush may be replaced by a scraper.

Figure 14:
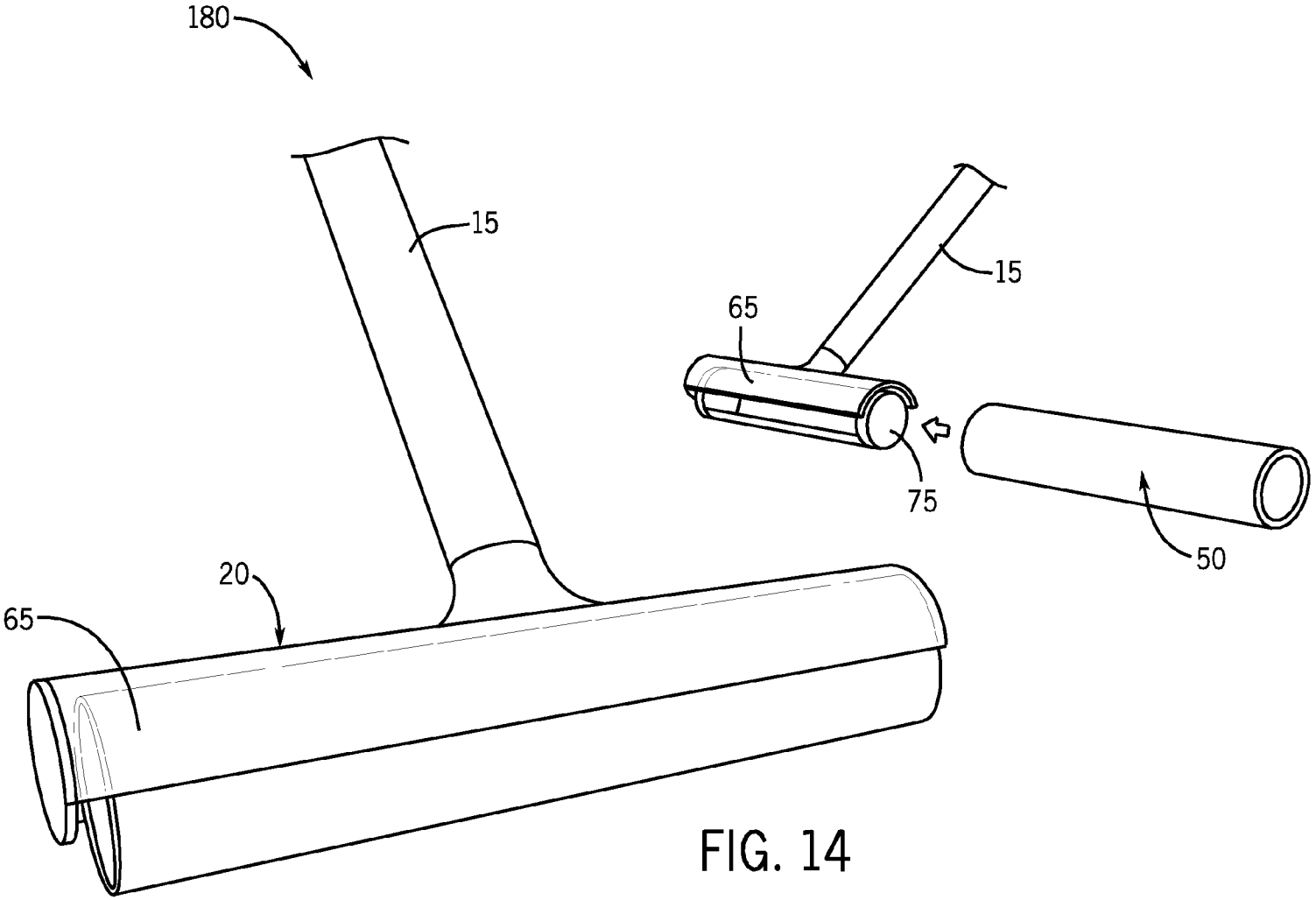
FIG. 14 is an isometric view of the base of the pickup device constructed according to the present invention along with an exploded, isometric view showing the replacement of the device's roller.

Referring to FIG. 14, in yet another embodiment, the device 180 may have a roller 50 that is on sleeve that is completely replaceable, like a conventional paint roller. The device 190 may lack a bin, but has a base 20 consisting of a housing 65 in communication with a roller mount 75. The roller 50 preferably slides on to the roller mount 75.

Figure 15:
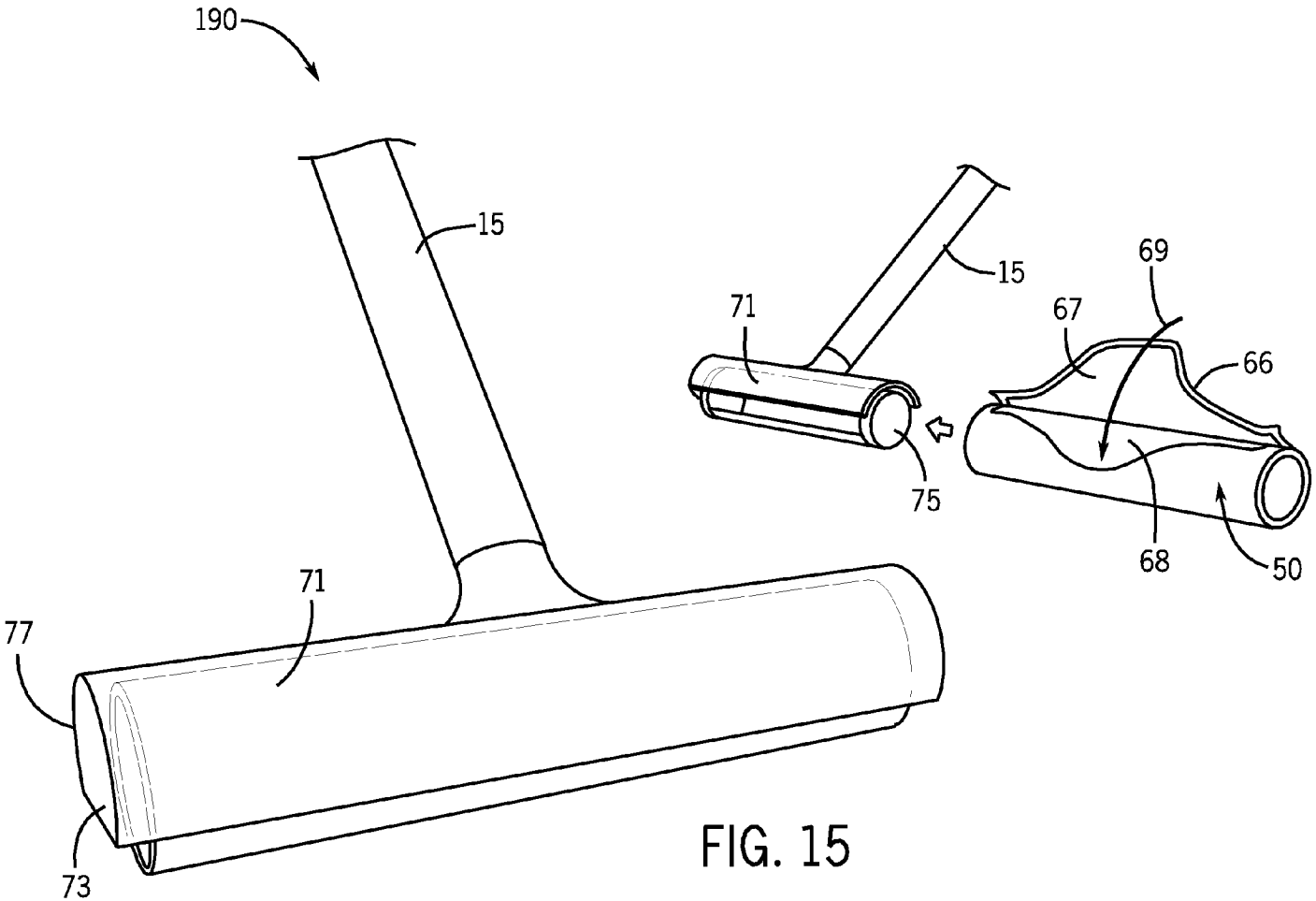
FIG. 15 is an isometric view of the base of the another pickup device constructed according to the present invention along with an exploded, isometric view showing the replacement of the device's roller pad.
Figure 16:
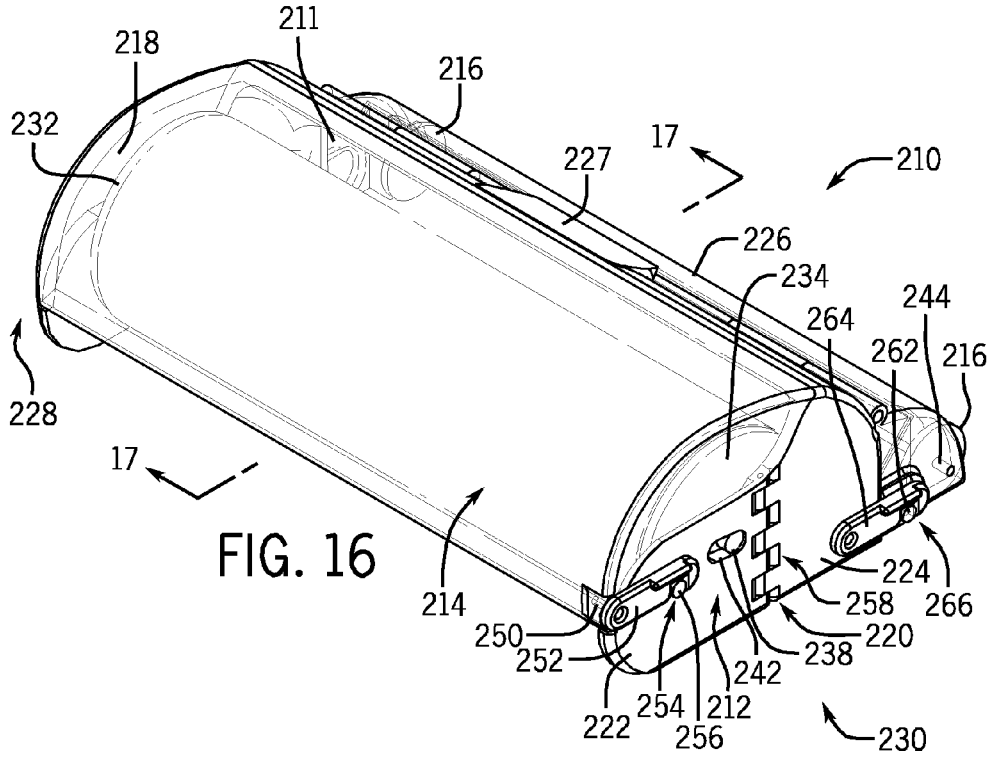
FIG. 16 is an isometric view of a representative construction of yet another embodiment of the pickup device constructed in accordance with the present invention.

Turning now to FIG. 15, another embodiment of the device 190 may have a roller 50 that is removable and a roller pad 66 that is replaceable. The device's roller 50 may have a new pad 66, for example, attached to a Velcro®-like surface 68, with the inner surface of the replacement pad 66 having a hook texture 67 that mates with the eye/loop texture of roller surface 68. The pad 66 may be applied to the roller 50 in a wrapping motion 69 and the assembled pad 66 and roller 50 may be mounted on the roller mount 75. In addition, the housing 71 may have a front portion 73 and back portion 77 wherein the front portion 73 may be lifted to access the roller for removal or mounting (not shown).

In one embodiment, the device's handle may be removable and/or adjustable. For example, the handle may be replaced with a smaller handle or may be made up of sections that come apart to provide a shorter or longer handle depending on the application. In another embodiment, the handle may be telescoping. The handle, like other components of the device, may be made of wood, plastic, metal, or any other suitable rigid and durable material.

As mentioned above, the inventive device's ability to capture dirt and debris in 3-dimensional capture matrix provides an increased debris-holding capacity and surface area versus the prior art flat tape or 2-dimensional pad or tape. For example, the matrix preferably includes a free-moving capture media, such as spheres or cylinders, that rotate or tumble to remove and capture debris from the roller where it adheres to the capture media or within the collection bin. Preferably, the capture media is made of a material that is durable, tacky, absorbent, and/or has excellent surface tension. The material preferably allows the media to stay whole, hold debris, easily tumble, stay free without clumping together, and remain firm enough to avoid getting smashed by the roller. The capture media may be constructed of a variety of materials, e.g., rubber, fuzzy material, neoprene, wood, plastic, and/or wicking spheres. These materials may also include a superabsorbent polyacrylamide, co-polymer, and/or bisacrylamide with water infusion. In one embodiment, the media is washable and/or replaceable.

In one embodiment, the capture matrix is preferably made up of spheres that are contained in a disposable cartridge that is placed in the collection bin. In this embodiment, the spheres are lightly tacky and moist to facilitate pickup, but are allowed to move freely avoiding cohesion. The capture media spheres are infused with water to provide the optimum surface tension and stickiness to attract debris while remaining slippery enough to prevent cohesive bonding of the media.

The capture media within the collection bin is such that it may attract debris from the roller. The bin preferably retains the media within a cage including a thin mesh or a grate that allows the media to interface with the tacky roller, yet not escape and potentially be drawn out onto the floor by the tacky roller.

As mentioned above, the roller of the device preferably has a tackiness or attractiveness to pick debris off any floor surface. This tackiness needs to be in proper range, however; for example, if the roller is too tacky and the user will not be able to get the material off the roller to later refresh it. If the roller is not tacky enough, the user will not be able to the material off the floor. Thus, the proper durometer and thickness of material is required to optimize pickup. For example, many silicones and polyurethanes work well and, specifically, a polyurethane blended with fillers seems to work best from a tackiness (surface-energy) standpoint and durometer. Adding a texture to the roller surface increases pickup surface area and makes it easier to clean off. One material known in the prior art is currently found in a cleaning tool called Mr. Sticky. See www.buymrsticky.com. In one embodiment, the roller may be constructed of a hook and loop fastener type material and covered with a tacky gel. In another embodiment, the gel, e.g., Kelcogel, may be held in place on the roller with a mesh.

In one embodiment, the roller is refreshed by shaving, sanding, and/or scraping the tacky roller. In another embodiment, the roller may be washable. In another embodiment, the bin may be a reservoir that may be emptied.

As mentioned, preferably, a roller-refreshing member is provided on board the device. Applying moisture to the roller while in use facilitates cleaning off and capturing the debris, as well as, rejuvenating the tackiness. The best way to accomplish this action is by using 1) polyacrylamide water balls or carageenan balls or cylinders in double duty (dirt capture and roller washing), 2) a marker-type capillary element saturated with water (about 10-20 milligrams) that applies moisture via a nib across the roller, and/or 3) a saturated absorbent cylinder that rotates along with the tacky roller or is contained within the roller.

In one embodiment, the moisture-supplying and roller refreshing member may be a 3D rectangular, replaceable wick made of a compressed polyester/polymer fiber. The fiber may be compressed to a certain density to control liquid flow control. One supplier of this material is Filtrona PLC. In another embodiment, the wick may be a small, absorbent roller or pad that engages the roller along its entire length. Where a liquid is present, the liquid may contain cleaners, fragrances, deodorizers, anti-microbals, or disinfectants. Of course, these additives may also be contained in the capture media, e.g., the spheres or cylinders, or the roller itself, or the removal roller pad layer.

As discussed, in one embodiment, the roller refreshing apparatus includes a kneading roller or wheel(s) that knead a tacky putty-like substance on the roller. In another embodiment, a scrapper blade may be provided to slightly scrape the soiled roller surface away and provide for a new surface contained underneath. In this embodiment, the roller may be made of a cardboard tube that has a roller surface made of carageenan. Here the roller may be sold in a package that is flat and then must be popped open and secured to the handle with a pair of insertion disks that have a male portion that can be inserted into the ends of the roller tube.

In one embodiment, as mentioned, a centrally located clean-off brush aids in cleaning material off the tacky roller. Some material is cleaned off directly by the capture media, while others require the brush to dislodge it so that it can be ultimately captured by the capture media. The brush preferably provides a flicking action to dislodge debris stuck to the roller surface. The brush needs to be rigid enough do its job, but not too rigid so that it imparts too much resistance to the roller and makes it difficult for the user to push the device along the floor.

In one embodiment, a debris containment mechanism, e.g., containment wipers or brushes may be provided near the clean-off brush. These durable brushes or wipers work to keep debris trapped inside a disposable cartridge and do not allow the debris to fall back onto the floor. They may aid slightly in cleaning of the roller as well. These could be executed in a variety of forms, perhaps, as plastic flaps molded into the base housing, extensions of the disposable cartridge, separate plastic film parts, rubber flaps, etc.

When in use, the inventive quick pickup device is moved across a surface to be cleaned in a back and forth motion. In one embodiment, the roller fits in a slot in the base. This preferably elliptical slot allows the roller to engage the wiper only in the forward stroke direction. In the pull back stroke, the roller is disengaged.

The inventive device preferably captures a variety of debris materials—hair, grass, inorganic, skin, sand, soil, food crumbs, etc.

The device may be used on hard floors, carpet, throw rugs, automobiles, upholstery, clothing, or any of a number of surfaces.

It is possible that other cleaning and fragrancing options may be included within the device. For example, steam cleaning technologies may be added, fragrancing may be added to the matrix gel or roller, disinfectant may be added to the roller or matrix as may a cleaning chemistry, a shine chemistry, etc. The matrix also may be constructed of water permeable bags of gel powder.

With additional reference now to FIGS. 16-22, another embodiment of a cleaning device 210 is illustrated. The cleaning device 210 includes a housing 212. The housing 212 defines a pair of cavities, a forward cavity and a rearward cavity. The forward cavity houses a roller 214 that is rotatably secured to the housing 212 and the rearward cavity rotatably houses a pair of opposed wheels 216 at either end of the housing 212 and configured, along with the roller 214, to facilitate movement of the cleaning device 210 over the surface to be cleaned. While the device 210 is not shown including a handle, it is understood that the device may include a handle similar to that shown in the previous embodiments for grasping by an operator for manipulation of the device 210.

The housing 212 includes a lid member 218 situated at a forward end of the housing 212, a base member 220 including a forward portion 222 and a rearward portion 224, and a rear door member 226. The lid member 218 may be generally dome-shaped to correspond to the shape of the roller 214 or may be any other suitable shape. The lid 218 also serves to define a chamber for collecting debris picked up by the roller 214, which may then be emptied when the lid 218 is opened. The lid member 218 may be transparent and constructed out of plastic or may be generally opaque or any combination thereof. Understandably, the lid member 218 may be constructed from other materials including metals and the like. The base member 220 is coupled between the lid member 218 and the rear door member 226 and is configured to rotatably support the roller 214. Moreover, the lid member 218 and the rear door member 226 are movably coupled to the base member 220 as will be articulated in addition detail herein. The rear door member 226 along with the base member 220 define the rearward cavity that houses the wheels 216 as previously discussed and defines a debris collection bin 211 for receiving the particulate matter picked up by the roller 214. In particular, the rear door member 226 may define the debris collection bin and may be either rotatable about a pin or similar element to open the rear door member 226 for emptying the debris collection chamber or may be entirely removable from the base 220. In this manner, the debris collection bin 211 may be carried away from the device 210 for disposing of the contents thereof. In one construction, the rear door member 226 may include a hook or similar structure configured to engage a portion of the base 220 and wherein the hook may be removably coupled to the base 220 for removal of the collection bin 211 from the base 220. Moreover, the rear door member 226 may include a handle 227 or similar structure for grasping by an operator thereof for carrying the device 210 or for carrying the debris collection bin 211 as may be appreciated. The handle 227 may also facilitate opening of the rear door member 226.

The roller 214 may be covered with or otherwise have adhered to it a material configured to pick up particulate matter when the roller 214 is applied to a surface to be cleaned. The material covering the roller 214 may be like that previously discussed herein. In one construction of the roller 214, the roller 214 is covered with or is otherwise configured to rotatably carry and support a gel material. The gel material may include low acyl gellan and a high acyl gellan or gellan gum such as those produced by Kelocogel®. The combination of the two gels results in a durable and impact resistant gel while maintaining a relatively soft and wet surface that is adept at picking up dirt and other particulate debris. The formula of the gel may have a mix of both of the low and high acyl gellans at 2-4% total gum and more preferably at 4% total gum. A preservative may be added to the gel to prevent molding. Also, potassium sorbate or a similar compound may be added for the purpose of smoothing and providing a homogenous gellan during the mixing process as it is being hydrated. Other compounds such as deionized water, salt, and sorbitol solution may be added to the gel as desired. Other additives such as glycerin may be added to the gel to prevent the gel from drying out. Understandably, any number of similar such compounds may be used. In addition, the gel may be impregnated with any number of additives such as those for providing a fragrance, tackiness, or shininess or other additives such as anti-bacterial, fungicide, and other such cleaning solutions as are known in the art.

Any number of methods may be used to apply the gel to the roller 214. In a first embodiment of the roller 214 of the present construction, a sheet of scrim material or a thin mesh may be provided and include a connecting arrangement on one side thereof such as, for example, Velcro or the like. The gel may then be tapped or otherwise embedded into the other side of the mesh for bonding thereto. The mesh sheet is then velcroed or otherwise connected to the roller substrate such that the gel side is provided on an external surface of the roller 214. In another construction a scrim or mesh material may have the gel applied as previously described and the material may be glued or otherwise adhered to a tubular member such as a cardboard tube that is sized, shaped, and configured for being received over the roller substrate. In yet another method of applying the gel to the roller 214, a thicker gauge plastic matrix is extruded as a cylinder having holes and the gel is cast onto the plastic cylinder as may be generally understood in the art.

The gel material of the roller 214 may be configured so that particulate debris of a given size or characteristic may be embedded therein during operation. That is, as the debris is picked up off the surface to be cleaned it is forced into the gel material through the subsequent contact between the roller 214 and the surface to be cleaned. In this manner, the external surface of the roller 214 may be kept relatively clean so that debris picked up is not transmitted back to the surface to be cleaned during subsequent applications. Other particulate debris may be of the size and characteristic that it will be deposited into the debris collection bin 211. In particular, as the roller 214 rotates, that debris will be directed into the debris collection bin 211 that is positioned rearward of the roller 214 and forward of the rear door member 226.

The roller 214 includes a pair of opposed ends 228 and 230 which may include a support structure for the roller 214 configured to couple the roller 214 to the housing 212. In particular, each of the ends 228 and 230 may include an end cap 232 and 234 respectively coupled to the roller 212. The end caps 232 and 234 may include respective projections 238 configured to be received by the base 220 of the housing 212. In particular, the base 220 may include a hole, aperture, recess, or other such feature, collectively holes 242, respectively, configured to receive the respective projections 238. In this manner, the roller 214 is rotatable about a horizontal axis defined by the projections 238.

The wheels 216 are secured within a rear portion of the housing 212 as previously indicated. The wheels 216 may include a single axle coupling the wheels 216 to one another or may each include an axle or projection 244 configured to engage a side wall of the rear door member 226. The rear door member 226 may include a pair of corresponding holes, apertures, recesses, or the like for receiving the projections 244 for enabling rotation of the wheels 216 with respect thereto. The rear door member 226 may include a pair of opposed slots 246 corresponding with the locations of the wheels 216 and configured to rotatably support the wheels 216 therein. In this manner, the wheels 216 may project rearwardly from the rear door member 226 by a predetermined distance.

As indicated previously, the lid member 218 is movable relative to the base 220 of the housing 212. The lid member 218 may include a pair of opposed recesses (not shown) on each end thereof for receiving a corresponding pin 250 of the base member 220. The pins 250 may be carried by a clip member 252 configured to be selectively secured between the base 220 and the lid member 218 to selectively prevent the lid member 218 from rotating about the pins 250. In particular, the clip members 252 may extend from a forward edge of the base member 220 toward the rearward end. The clip members 252 may include a notch 254 for engaging a pin 256 projecting from a respective side of the base 220. To secure the lid member 218 to the base member 220, the clip may be rotated about the pin 250 so as to engage the pin 256 with the notch 254 at its opposite end. To move the lid 218 relative to the base 220, the clip member 252 may be rotated in the opposite direction so that the notch 254 is disengaged from the pin 256 so that the lid may then rotate about the pins 250.

The base member 220, as previously articulated, includes a forward portion 222 and a rearward portion 224 that are movably coupled to one another. In particular, the forward portion 222 and the rearward portion 224 may be hingedly coupled to one another by a hinge arrangement 258. In particular, the forward portion 222 and the rearward portion 224 of the base 220 are coupled to one another so that the forward portion 222 may be moved between a first, locked position in which the roller 214 is secured to the base 220 as previously discussed and a second, unlocked position in which the forward portion 222 is rotated away from the roller 214 so that the projections 238 are disengaged from the holes 242. In this manner, the roller 214 may be removed from the housing 212 for cleaning, disposal or replacement thereof.

The rear door member 226 is movably coupled to the base 220. In particular, the rear door member 226 may be movably coupled to the rearward portion 224 of the base 220. The rear door member 226 may be coupled to the base 220 by way of a hinge arrangement 260 disposed along a longitudinal axis of the device 210 and between the base 220 and the rear door member 226. Thus, to rotate the rear door member 226 about the hinge arrangement 260, the user may rotate the rear door member 226 about a horizontal axis to expose the rear of the device 210 and more particularly to enable the operator to empty the bin 211 located therein. The rear door member 226 may be latched to the base 220 to prevent accidental or unwanted opening thereof. In particular, the rear door member 226 may include a projection 262 disposed thereon that is configured to be engaged by a clip 264 having a notch 266 sized and shaped for engagement with the projection 262. The clip 264 may be rotatable between a locked and unlocked position to secure the rear door member 226 relative to the base 220 or to free it relative thereto for rotation thereof for emptying of the bin 211 or for performing maintenance on the wheels 216 or the like.

Figure 18:
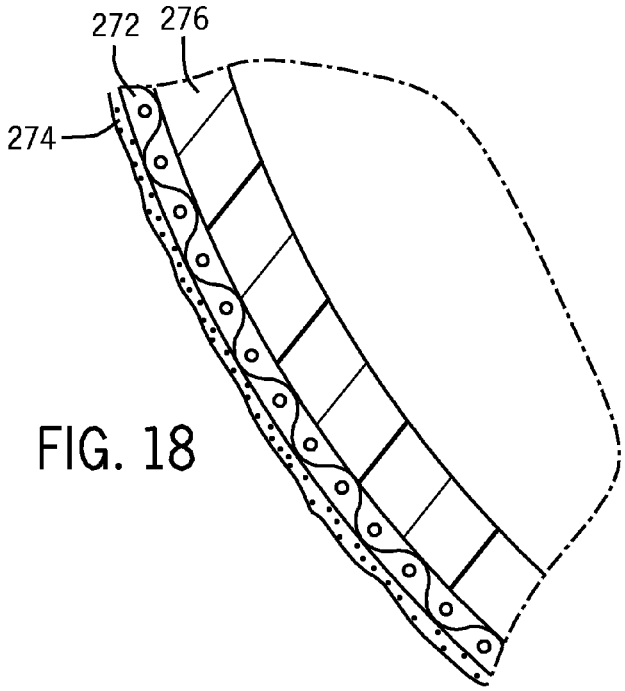
FIG. 18 is a cross section view of a roller of the pickup device of FIG. 17 taken along the line 18-18.
Figure 19:
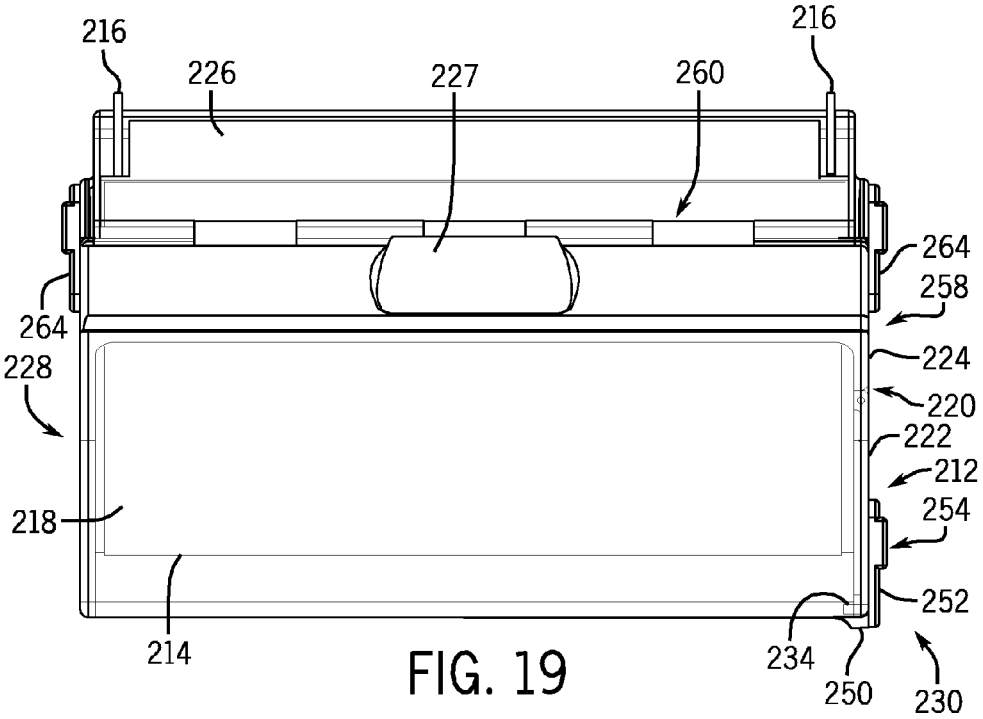
FIG. 19 is a top plan view of the pickup device of claim 16.
Figure 20:
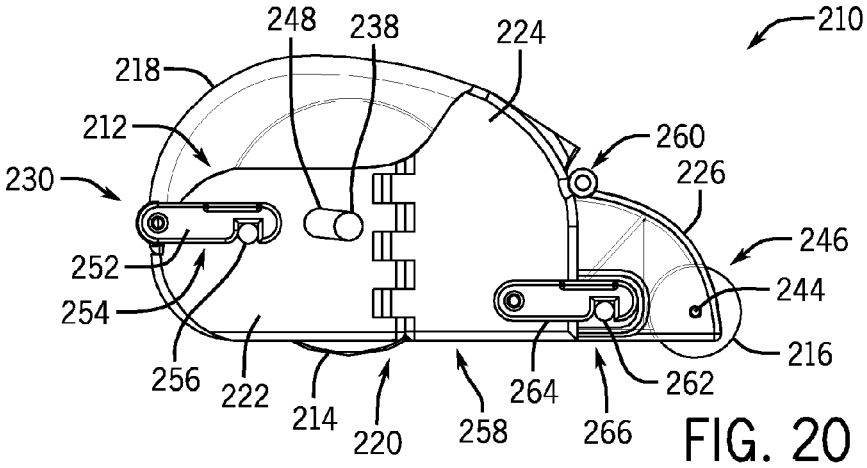
FIG. 20 is a side elevation view of the pickup device of claim 16.
Figure 21:
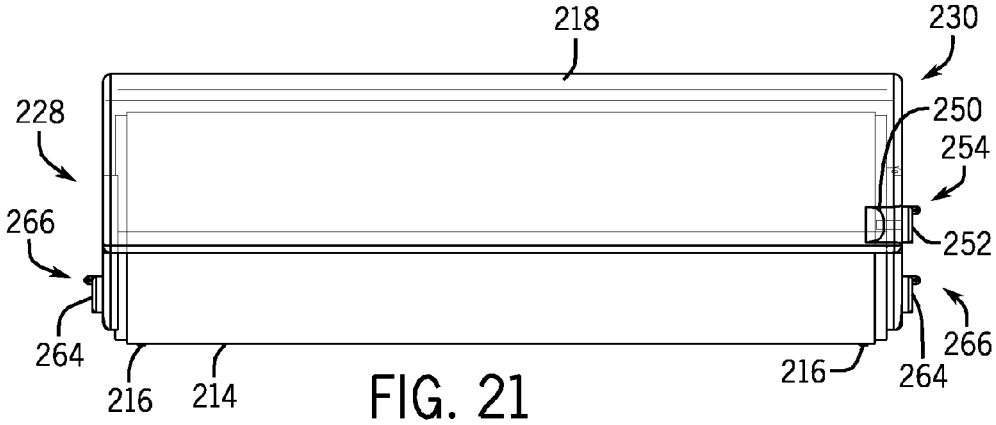
FIG. 21 is a front elevation view of the pickup device of claim 16.
Figure 22:
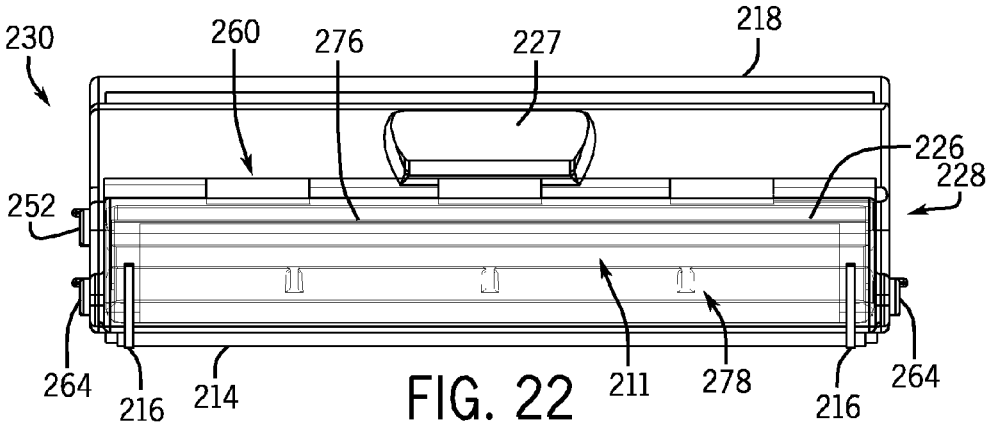
FIG. 22 is a bottom plan view of the pickup device of claim 16.

With specific reference now to FIG. 18, a cross-sectional view of the roller 214 according to the present construction is provided. The roller 214 includes a base or substrate layer 270, which may be plastic or any other suitable material for serving to support the rest of the roller 214. A mesh or scrim layer 272 is applied to the substrate layer 270. The mesh or scrim layer 272 may be carried by another intermediate material such as a cardboard tube or the like or it may be applied directly to the roller 214. The mesh or scrim layer 272 supports a gel layer 274 adhered thereto as previously described. The gel layer 274 provides the external, surface-engaging portion of the roller 214 and is especially configured for picking up particulate debris as previously described.

Figure 17:
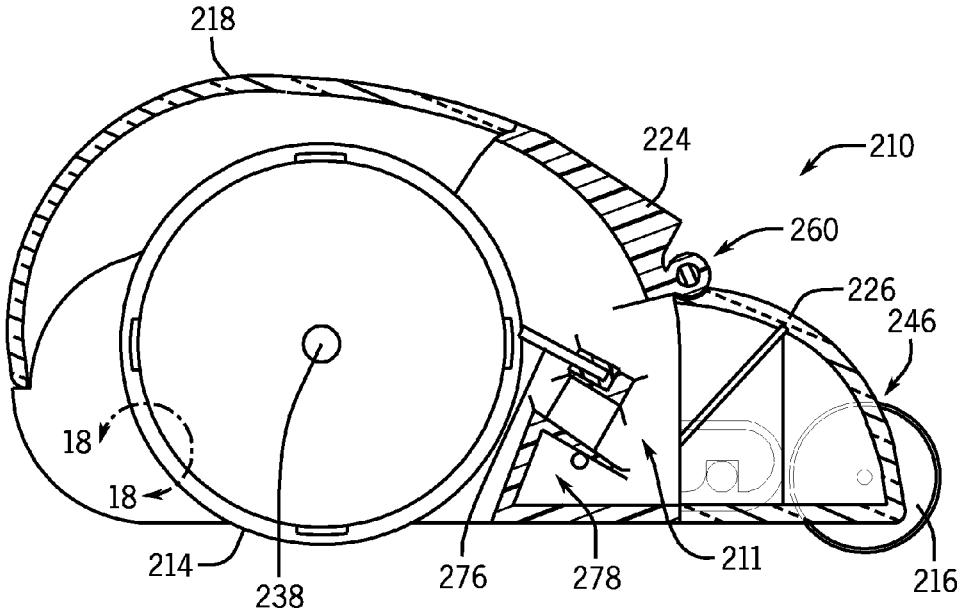
FIG. 17 is a cross section side elevation view of the pickup device of FIG. 16.

With specific reference now to FIG. 17, the roller 214 is configured to rotatably engage a diverting member 276, which is supported or carried by a lower portion 278 of the housing 212. The diverting member 276 is configured to engage the roller 214 during operation so that particulate debris carried by the roller may be removed from the roller 214 and directed to the bin 211. In this manner, the roller 214 is kept generally free of debris so that it may be used to subsequently pick up additional debris during operation. In at least one construction of the device 210, the diverting member 276 is a brush including a number of bristles or similar elements configured to engage the debris on the roller 214 and configured to remove the debris from the roller 214 so that the debris is brushed into the debris collection bin 211. The diverting member 276 may be held in a cantilevered fashion by a portion of the lower portion 278 so the free end of the diverting member 276 is engaged with the roller 214.

During development, a tacky surface durability testing machine was created. A soil-depositing and pickup measuring machine was also developed. A tackiness testing device was also developed to help formulate a material with the right pickup characteristics.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

Various alternatives are contemplated as being within the scope of the following claims particularly pointing out and distinctly claiming the subject matter regarded as the invention.

The invention claimed is:

1. A cleaning device comprising:

a housing defining an interior including a debris collection bin;

at least one roller rotatably coupled to the housing;

a tacky material circumferentially disposed about the at least one roller and configured to be applied to a surface to be cleaned for picking up particulate matter therefrom; and wherein the tacky material comprises a gel applied to and received over the at least one roller.

2. The cleaning device of claim 1, wherein the tacky material comprises a combination of two or more gels.

3. The cleaning device of claim 1, wherein the housing further comprises a lid movably coupled to a base for selectively covering the at least one roller.

4. The cleaning device of claim 1, further comprising a pair of opposed wheels positioned rearward of the at least one roller.

5. The cleaning device of claim 1, further comprising a debris diverting arrangement configured to selectively engage the at least one roller to divert debris on the roller into the debris collection bin.

6. The cleaning device of claim 1, wherein the housing comprises, a base;

a lid movably coupled to the base to selectively expose the roller;

a rear door movably coupled to the base to selectively empty the debris collection bin.

7. The cleaning device of claim 1, wherein the roller is removably coupled to the housing for replacement thereof.

8. The cleaning device of claim 1, wherein the debris collection bin is removably coupled to the housing.

9. A method of making a cleaning device comprising the steps of:

constructing a housing defining an interior including a debris collection bin;

coupling a roller to the housing within the interior and in communication with the debris receiving bin, wherein the roller is rotatably coupled to the housing and configured to divert collected debris to the bin; and adhering a tacky material to the roller, wherein the tacky material is configured to attract debris when the cleaning device is applied to a surface;

wherein the tacky material is a gel.

10. The method of claim 9, wherein the step of adhering the tacky material comprises the steps of, coupling a substrate to the roller; and applying the tacky material to the substrate.

11. The method of claim 9, wherein the gel is a combination of at least two gels.

12. The method of claim 9, further comprising the step of, creating the tacky material by combining at least two gels together.

13. The method of claim 9, further comprising the step of providing a debris diverting arrangement comprising at least one diverting member situated to be engageable with the roller during operation for diverting debris to the debris collection bin.

14. A roller for a cleaning device, the roller comprising:

a circumferential substrate having opposing first and second ends; and a tacky material coupled to the substrate and configured to pick up particulate matter from a surface to be cleaned, wherein the tacky material comprises a gel.

15. The roller of claim 14, wherein the tacky material comprises a combination of at least two gels.

16. The roller of claim 14, further comprising a matrix configured to be removably coupled to the substrate and for carrying the tacky material.

17. The roller of claim 16, wherein the matrix comprises a mesh material including a plurality of pores configured to receive the tacky material.

* * * * *